US005217347A

United States Patent [19]

Miraucourt et al.

[11] Patent Number: 5,217,347

[45] Date of Patent: Jun. 8, 1993

[54] MOUNTING SYSTEM FOR A STATOR VANE

[75] Inventors: Carmen Miraucourt, Brie Comte Robert; Philippe Thieux, Montgeron, both of France

[73] Assignee: Societe Nationale d'Etude et de Construction de Moteurs d'Aviation (S.N.E.C.M.A.), Paris, France

[21] Appl. No.: 940,360

[22] Filed: Sep. 3, 1992

[30] Foreign Application Priority Data

Sep. 5, 1991 [FR] France ..... 91 10966

[51] Int. Cl.[5] ..... F01D 9/04

[52] U.S. Cl. ..... 415/115; 415/136; 415/137

[58] Field of Search ..... 415/115, 116, 134, 136, 415/137, 138, 139, 209.2, 209.3, 209.4, 210.1; 416/96 R, 96 A, 97 R

[56] References Cited

U.S. PATENT DOCUMENTS 3,471,126 10/1969 Abild .
3,807,892 4/1974 Frei et al. ..... 416/116
4,288,201 9/1981 Wilson .

FOREIGN PATENT DOCUMENTS 1359439 12/1987 U.S.S.R. ..... 415/116
2210415 6/1989 United Kingdom .

OTHER PUBLICATIONS

Patent Abstract (Japan) vol. 8, No. 54 (M-282) (1491) Mar. 10, 1984.
Patent Abstract (Japan) vol. 10, No. 326 (M-532) (2382) Nov. 6, 1986.

*Primary Examiner*—Edward K. Look
*Assistant Examiner*—Christopher Verdier
*Attorney, Agent, or Firm*—Bacon & Thomas

[57] ABSTRACT

A mounting system for a stator vane assembly is disclosed for mounting a vane and its cooling system to minimize the thermal and mechanical stresses imparted to the vane structure. Platforms are attached to opposite ends of the vane, which has a hollow interior and a cooling gas distributor located within the interior of the vane. One end of the cooling gas distributor is also fixedly attached to one of the vane platforms, while the opposite end of the cooling gas distributor is attached to a casing, not to the opposite vane platform. Spaces are defined between the cooling gas distributor and the vane platform, as well as the casing and the vane platform. A gas inlet sleeve may be attached to the cooling distributor and serve as its attachment to the external casing. The gas inlet sleeve extends through an opening in the vane platform which may have a greater diameter than that of the sleeve in order to provide a cooling passage interconnecting the spaces between the vane platform and the cooling gas distributor, and the vane platform and the casing.

4 Claims, 1 Drawing Sheet

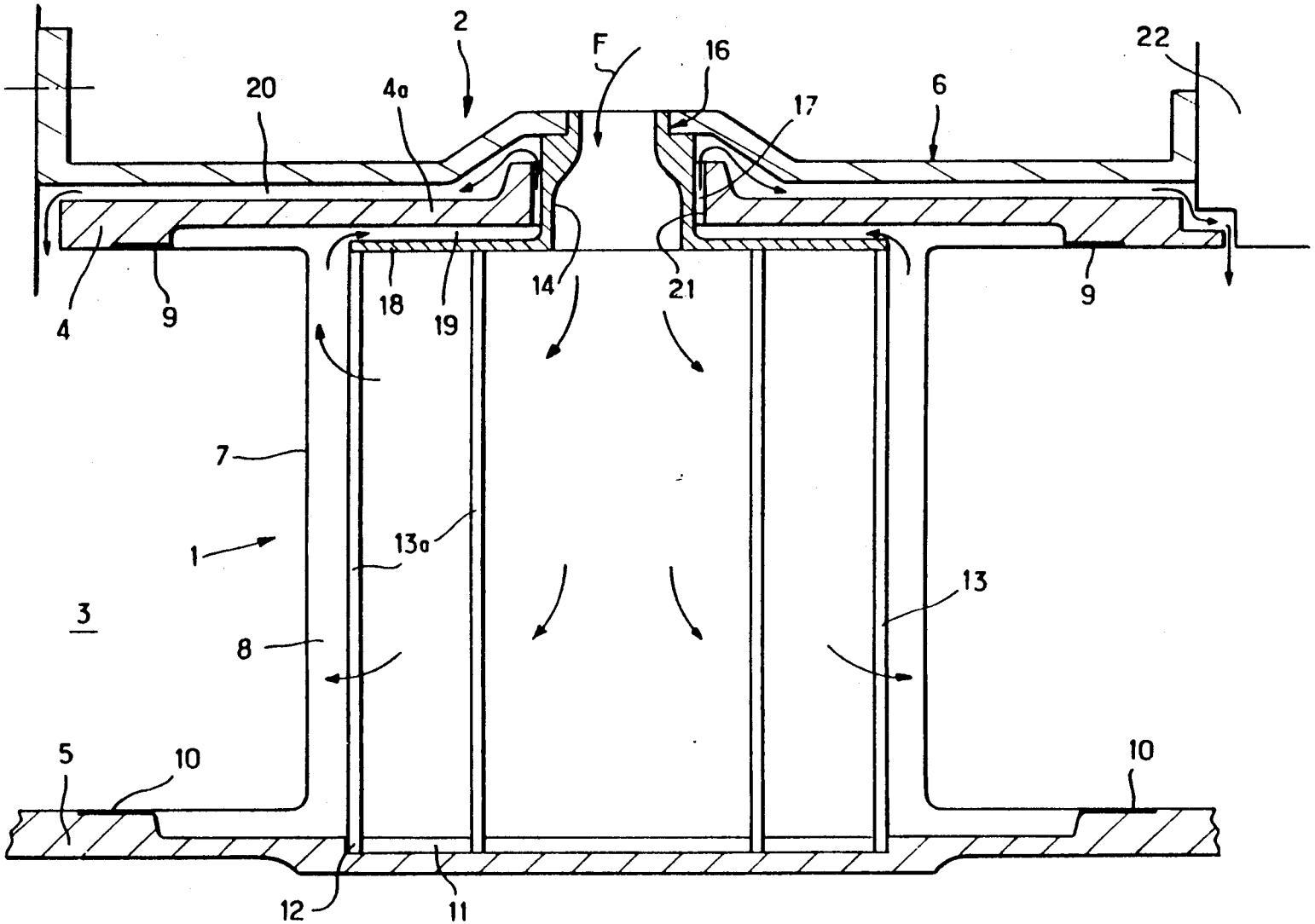
22
6
17
16
F
2
4a
20
9
4
3
5
10
7
1
8
12
11
13a
18
19
14
21
16
17
6
9
22
13
10

MOUNTING SYSTEM FOR A STATOR VANE

BACKGROUND OF THE INVENTION

The present invention relates to a mounting system for a stator vane in a turbine nozzle having a plurality of radially extending, circumferentially spaced vanes to direct the flow of hot gases emanating from a combustion chamber onto the blades of a turbine wheel.

It is well-known to provide at least one row of stationary vanes adjacent to the exit of a combustion chamber in a gas turbine engine to direct the gases emanating from the combustion chamber onto the blades of a turbine wheel. The nozzle vanes serve to direct the gases onto the movable blades in a direction which increases the efficiency of the turbine wheel.

Quite obviously, the gases emanating from the combustion chamber are extremely hot thereby causing the nozzle vanes and the blades of the turbine wheel to undergo substantial thermal and mechanical stress. It is also known to provide the nozzle vanes, as well as turbine blades, with a cooling fluid, such as air withdrawn from a compressor stage of the gas turbine engine. Typically, such known cooling systems involve directing the air internally into the hollow vane or blade such that it impinges on the inner surface of the vane or blade. The cooling fluid may then be extracted from the interior of the vane or blade by holes through a surface of the vane or blade, or by passages defined by the vane or blade mounting system. Since the cooling fluid is at a lower temperature than the vane or its mounting structure, exposure of this system to the cooling fluid may add additional mechanical and thermal stresses to the vane and its mounting system.

U.K. Patent Application 2 210 415 discloses a cooled turbine vane comprising a cooling sleeve located in the interior of the hollow vane wherein one end of the sleeve is affixed to an outer platform which is, in turn, attached to the vane, while the opposite end of the cooling sleeve is unattached. In this particular design, the external vane casing must withstand both high temperature and mechanical stresses.

U.S. Pat. No. 4,288,201 discloses a vane cooling structure wherein an inner cooling tube has one end attached to one of the blade platforms, while a cooling gas inlet sleeve is fixedly attached to the opposite vane platform.

It is well-known in the art that the mechanical strength of an article decreases at high temperatures.

SUMMARY OF THE INVENTION

A mounting system for a stator vane assembly is disclosed for mounting a vane and its cooling system to minimize the thermal and mechanical stresses imparted to the vane structure. Platforms are attached to opposite ends of the vane, which has a hollow interior and a cooling gas distributor located within the interior of the vane. One end of the cooling gas distributor is also fixedly attached to one of the vane platforms, while the opposite end of the cooling gas distributor is attached to a casing, not to the opposite vane platform. Spaces are defined between the cooling gas distributor and the vane platform, as well as the casing and the vane platform. A gas inlet sleeve may be attached to the cooling distributor and serve as its attachment to the external casing. The gas inlet sleeve extends through an opening in the vane platform which may have a greater diameter than that of the sleeve in order to provide a cooling passage interconnecting the spaces between the vane platform and the cooling gas distributor, and the vane platform and the casing.

The mounting system according to the present invention exposes the vane's exterior surface solely to high temperatures and utilizes the colder nozzle components, such as the cooling gas distributor and the casing, to bear the majority of the mechanical stresses, thereby reducing vane distortion and increasing the vane life. The cooling gas distributor is fixedly attached between an inner vane platform and the external casing so as to bear the majority of the mechanical stresses imposed upon the system. The external vane platform, which is connected only to the vane, is spaced from both the external casing and the cooling gas distributor such that it does not bear any of the mechanical stresses, thereby prolonging the vane life and reducing vane distortion during use.

The external vane platform and the external casing may expand freely relative to each other in the radial direction, thereby preventing the mechanical stresses from being imparted to the vane itself. The cooling gas distributor, which is the coldest part of the vane system links the inner vane platform to the external casing and absorbs all of the mechanical stresses.

A clearance between the external vane platform and the sleeve which interconnects the casing to the cooling gas distributor provides a passage through which the cooling gases may be evacuated from the interior of the vane. This clearance may communicate with passages defined between the external vane platform and the external casing, and the cooling gas distributor and the external vane in order to withdraw the cooling gas from the vane interior.

BRIEF DESCRIPTION OF THE DRAWING

The single FIGURE is a partial, longitudinal, cross-sectional view of a turbine nozzle incorporating the mounting system according to the present invention.

DETAILED DESCRIPTION OF THE PREFERRED EMBODIMENT

The sole figure is a longitudinal cross-sectional view of a gas turbine nozzle 2 which cross-section passes through a vane assembly 1. The nozzle 2 comprises a plurality of such vane assemblies 1 circumferentially spaced about a longitudinal axis (not shown) of a gas turbine engine so as to define a generally annular hot-gas flow channel 3 which is bounded by an external platform 4 and an internal platform 5. As is known in the art, the extremely hot gases from a gas turbine engine combustion chamber (not shown) flow in an upstream-to-downstream direction, left to right as viewed in FIG. 1. The nozzle 2 is located within a casing 6 which is, in turn, fixedly attached to known engine structures.

The vane 1 comprises a vane casing 7 having an airfoil shaped cross-sectional configuration and which defines an inner cavity 8. The vane 7 has first and second ends which are fixedly attached to an external platform 4 and an internal platform 5 such as by brazing at 9 and 10, respectively. The internal platform 5 defines a recess 11 at a middle portion to receive the base 12 of a cooling gas distributor 13. Base 12 may be fixedly attached to the internal platform 5 such as by brazing.

The opposite end of cooling gas distributor 13 has a wall 18 extending thereacross which is, in turn, connected to sleeve 14 which defines a passageway communicating with the interior of the cooling gas distributor 13. Sleeve 14 is, in turn, fixedly attached to casing 6 at 16. As can be seen, the external platform 4 has a center portion 4*a* which defines an opening 17 through which the sleeve 14 passes. The opening 17 is larger than the outer dimension of sleeve 14 so as to define a clearance 21 therebetween. Clearance 21 may be an annular passage or groove. The wall 18 and the external platform 4 are radially spaced apart so as to define space 19 therebetween. Similarly, external vane platform 4 is radially spaced from casing 6 so as to define a second space 20 therebetween. Spaces 19 and 20 communicate with clearance 21 to provide a path for the removal of the cooling gas which has passed through the cooling gas distributor 13. The cooling gas may be distributed upstream of the vane and downstream of the vane, as indicated by the arrows in the figure.

The interior of the cooling gas distributor 13 defines a plurality of radially extending walls or protrusions 13*a* which define flow orifices for the cooling gas and define circulation channels for the cooling gas between the cooling gas distributor 13 and the interior of the vane 7. The walls 13*a* are connected to the wall 18 which extends substantially parallel to the vane platform 4.

In a variation of the structure illustrated, a seal may be provided between the downstream portion of the external platform 4 and the turbine structure 22 to prevent the cooling gas from passing between these elements. In that case, all of the cooling fluid passing through the clearance or the grooves 21 is reintroduced into the flow channel 3 upstream of the external platform 4.

Various other known features may be incorporated into the mounting system according to this invention, such as providing perturbing means of known kinds on the walls 13*a* so as to cause disturbances in the cooling gas, thereby increasing its cooling efficiency. Also, the vane 7 may define evacuation orifices to evacuate the cooling gas from its interior, in known fashion.

As can be seen, no physical connection exists between the cooling gas distributor 13 and the vane 7. Thus, the stresses acting on the cooling gas distributor 13 are not directly imparted to the vane 7 thereby preventing any distortion of the vane and isolating the vane 7 from the mechanical stresses on the cooling gas distributor 13.

As illustrated by the arrows F, cooling gas, such as air, is introduced into the cooling gas distributor 13 through the sleeve 14. The gas is then directed against the inner walls of the vane 7 to cool the walls either by impingement or convective cooling. The air is then withdrawn from the interior of the vane 7 and reintroduced into the flow channel 3 between the external platform 4 and the casing 6.

The foregoing description is provided for illustrative purposes only and should not be construed as in any way limiting this invention, the scope of which is defined solely by the appended claims.

We claim:

1. A mounting system for a stator vane extending across a hot gas flow channel comprising:

a) a vane having first and second ends, and an intermediate portion having an airfoil shaped cross-sectional configuration defining an internal cavity;

b) a first platform fixedly attached to the first end of the vane so as to seal the internal cavity at the first end of the vane;

c) a second platform fixedly attached to the second end of the vane so as to prevent escape of a cooling gas from the internal cavity between the second platform and the second end, the second platform defining an opening therethrough communicating with the internal cavity;

d) a casing located adjacent to, but spaced from the second platform so as to define a first space therebetween the first space communicating with the hot gas flow channel and the internal cavity;

e) a cooling gas distributor located within the internal cavity, the cooling gas distributor having a first end fixedly attached to the first platform and a second end fixedly attached to the casing.

2. The mounting system of claim 1 wherein the cooling gas distributor further comprises a wall extending across the second end of the cooling gas distributor, the wall defining a cooling gas inlet and being spaced from the second platform so as to define a second space therebetween communicating with the internal cavity and the opening defined by the second platform.

3. The mounting system of claim 2 further comprising a gas inlet sleeve extending between the wall of the cooling gas distributor and the casing through the opening defined by the second platform.

4. The mounting system of claim 3 wherein the second platform and the inlet sleeve define therebetween a passage connecting the first and second spaces.

* * * * *